US010781641B2

(12) United States Patent
Gholiof et al.

(10) Patent No.: US 10,781,641 B2
(45) Date of Patent: Sep. 22, 2020

(54) ROTARY CLAW DRILL BIT

(71) Applicant: SANDVIK INTELECTUAL PROPERTY AB, Sandviken (SE)

(72) Inventors: Hamidreza Gholiof, Sandviken (SE); Ralf Grief, Zeltweg (AT); Joseph Fader, Kennesaw, GA (US)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 15/545,250

(22) PCT Filed: Jan. 18, 2016

(86) PCT No.: PCT/EP2016/050868
§ 371 (c)(1),
(2) Date: Jul. 20, 2017

(87) PCT Pub. No.: WO2016/116390
PCT Pub. Date: Jul. 28, 2016

(65) Prior Publication Data

US 2018/0016849 A1 Jan. 18, 2018

(30) Foreign Application Priority Data

Jan. 23, 2015 (EP) ..... 15152283

(51) Int. Cl.

| | |
|---|---|
| ***E21B 10/43*** | (2006.01) |
| ***E21C 35/18*** | (2006.01) |
| ***E21B 10/62*** | (2006.01) |
| ***E21B 10/42*** | (2006.01) |
| ***E21B 10/48*** | (2006.01) |
| ***E21B 10/60*** | (2006.01) |

(52) U.S. Cl.
CPC ..... *E21B 10/43* (2013.01); *E21B 10/42* (2013.01); *E21B 10/485* (2013.01); *E21B 10/602* (2013.01); *E21B 10/62* (2013.01); *E21C 35/18* (2013.01)

(58) Field of Classification Search
CPC ..... E21B 10/42; E21B 10/43; E21B 10/62
See application file for complete search history.

(56) References Cited

U.S. PATENT DOCUMENTS

| | | | | |
|---|---|---|---|---|
| 3,382,940 A * | 5/1968 | Stebley | ..... | E21B 10/40 175/426 |
| 3,720,273 A | 3/1973 | McKenry et al. | | |
| 3,830,321 A * | 8/1974 | McKenry | ..... | E21B 10/02 175/332 |
| 4,813,501 A | 3/1989 | Mills et al. | | |
| 5,666,864 A | 9/1997 | Tibbitts | | |
| 5,735,360 A | 4/1998 | Engstrom | | |

(Continued)

FOREIGN PATENT DOCUMENTS

| | | |
|---|---|---|
| CN | 203655163 U | 6/2014 |
| DE | 3941609 C1 | 10/1991 |

(Continued)

*Primary Examiner* — Kipp C Wallace
(74) *Attorney, Agent, or Firm* — Corrine R. Gorski

(57) ABSTRACT

A modular rotary claw drill bit having a head is mountable at a body, the head mounting a plurality of front and gauge cutting picks. A cutting tip of each front pick is located at a different radial position at the head to optimise the flushing of cut material and to minimise pick wear during use.

12 Claims, 10 Drawing Sheets

(56) References Cited

U.S. PATENT DOCUMENTS

| | | | | |
|---|---|---|---|---|
| 2008/0066970 | A1 | 3/2008 | Zahradnik et al. | |
| 2008/0164073 | A1* | 7/2008 | Hall | A47C 3/00 175/432 |
| 2009/0057030 | A1* | 3/2009 | Didericksen | E21B 10/54 175/401 |
| 2010/0218999 | A1* | 9/2010 | Jones | E21B 10/55 175/413 |
| 2010/0270086 | A1* | 10/2010 | Matthews, III | E21B 10/00 175/425 |
| 2012/0267173 | A1* | 10/2012 | Jones | E21B 10/43 175/428 |
| 2015/0060149 | A1* | 3/2015 | Herman | E21B 10/43 175/374 |

FOREIGN PATENT DOCUMENTS

| | | | |
|---|---|---|---|
| FR | 2643414 | A1 | 8/1990 |
| GB | 2238736 | A | 6/1991 |
| GB | 2345930 | A | 7/2000 |
| JP | H05287974 | A | 11/1993 |
| WO | 2008069863 | A2 | 6/2008 |
| WO | 2012051648 | A1 | 4/2012 |

* cited by examiner

ROTARY CLAW DRILL BIT

RELATED APPLICATION DATA

This application is a § 371 National Stage Application of PCT International Application No. PCT/EP2016/050868 filed Jan. 18, 2016 claiming priority of EP Application No. 15152283.6, filed Jan. 23, 2015.

FIELD OF INVENTION

The present invention relates to a shear claw drill bit having a plurality of cutting teeth and in particular, although not exclusively, to a modular component bit in which the teeth are distributed at the bit to optimise penetration rate and minimising wear.

BACKGROUND ART

Rotary drill bits are used in a variety of different fields including drilling oil, gas and water wells within the mining industry. Additionally, earth boring bits are commonly used to create blast holes that are then filed with explosives. Various types of drill bit have been developed for this purpose including drag bits, claw bits and conical roller-cone bits. Some drill bits comprise cutting teeth mounted within specific pick holders whilst other bits are formed from a metal-carbide alloy that mounts abrasion wear resistant polycrystalline diamond (PCD) inserts.

To facilitate forward drilling and to reduce wear on the bit, debris from the borehole is transported rearwardly by applying a fluid (typically air) down the drill string to the bit that channels the fluid back though the space between the outside of the drill string tubes and the inner surface of the bore hole. A reduction in the efficiency of removal of the loosened material within the borehole may result in jamming of the bit and the accelerated wear of the cutting teeth. The teeth may also wear prematurely when drilling hard rock or when the bit deviates laterally during drilling. Example rotary drill bits are described in FR 2643414; GB 2,238,736; DE 3,941,609; U.S. Pat. No. 5,666,864; GB 2,345,930; WO 2008/069863; US 2009/0057030; US 2010/0270086.

However, conventional bit designs are disadvantageous for a number of reasons. For a single piece bit, when the cutting teeth become unacceptably worn, the entire bit requires replacement which is an inefficient use of material. Additionally, the distribution of the cutting teeth at the bit head is not optimised to minimise teeth wear. Accordingly, what is required is a rotary drill bit that addresses the above problems.

SUMMARY OF THE INVENTION

It is an objective of the present invention to provide a rotary drill bit optimised to flush axially rearward cut rock fragments and fines to facilitate axially forward penetration of the bit during drilling. It is a further specific objective to both minimise wear of the cutting picks and to minimise, as far as possible, a non-uniform or differential rate of pick wear at the head so as to maximise the time period between servicing, repair or interchange of the bit and/or the picks. It is also a further objective to maintain or improve the guidance or steering characteristic of the bit whilst optimising penetration rate and minimising bit wear.

It is a further specific objective to provide a drill bit that is energy efficient and in particular to provide a re-buildable modular drill bit in which component parts of the bit may be recycled for subsequent use following repair or replacement of other components of the modular assembly.

The objectives are achieved by providing a modular drill bit having a drill bit head attachable to a drill bit body. Advantageously, different heads may be interchanged at the body as they become worn such that the body is considered to be a recyclable component of the bit. Accordingly, and preferably the head and body comprise respective mating components that facilitate alignment and attachment together. The present head and body are further configured to facilitate secure attachment typically by welding. In one aspect, the head and body comprise approximately planar mating attachment surfaces between which suitable weld material may be deposited to rigidly attach the head at the body.

To optimise the axially rearward flushing of cut material and to both minimise pick wear and in particular differential pick wear, the majority of the picks are located at different radial and optionally axial positions at the head. Accordingly, an axially forwardmost cutting tip of each pick is configured to contact the rock face during rotation of the pick about its central longitudinal axis to maximise the rock fracturing and crushing characteristics of the bit. Due to the spatial position of the picks, all picks are effectively working at a similar rate to provide substantially uniform wear. The present rotary bit may be considered to comprise one or a plurality of radially inner front picks and a plurality of radially outermost and axially rearwardmost gauge picks. Preferably, the radially inner front picks are each positioned at different radial and axial positions (relative to one another) whilst the gauge picks may be located at approximately the same radial separation from the axis and at similar axial positions (for example relative to the axially rearward facing attachment surface of the head).

Optionally, to assist optimisation of the cutting and wear characteristics of the bit, the picks may be arranged into groups according to their angular alignment with each group comprising a radially innermost and a radially outermost (gauge) pick. In particular, each group may comprise picks having the same or a similar angular alignment that is different to the angular alignment of the picks of another group. To further optimise the rock breaking and axially rearward flushing characteristics whilst minimising pick wear, an angular alignment of each pick within each group may be slightly different where the difference between the angular alignment of picks within the same group is less than the difference in the angular alignment between the picks of different groups.

According to a first aspect of the present invention there is provided a rotary claw drill bit comprising: a body having a rearward region for attachment of the bit to a drill string, a bore extending axially through the body; a head provided at a forward end of the body and having an axially extending bore to align with the bore of the body; a plurality of picks mounted at the head, each pick having a cutting tip; the picks including radially inner front picks and radially outermost gauge picks; characterised in that: the head and body are non-integrally formed; and a radial separation distance of the tips of each of the front picks from the axis is different.

Within the specification reference to 'angular alignment' of the cutting picks refers to the angular alignment of a longitudinal axis of each pick relative to the longitudinal axis of the bit, the longitudinal axis of other picks at the head and/or the angular alignment relative to the circumferentially extending rotational path of each pick (the rotational direction). The angular alignment of each pick is generally axially forward facing such that a base of each pick is positioned closest to the longitudinal axis of the bit relative to a cutting tip of each pick. Additionally, each pick is also tilted in the rotational direction of the head such that the cutting tip represents the leading part of the pick during rotation. Each pick therefore is aligned at the head at a compound angle to be tilted axially relative to the bit axis and to lean forward in the circumferential rotational direction. Due to the differential positioning of each pick at the head, the radial and axial positions of the circular orbital path of each tip is different to optimise rock breaking and flushing and to provide uniform pick wear.

Preferably, the bore of the head exits the head as a single opening positioned at the axis of the bit. Such a configuration is advantageous to optimise the radially outward and axially rearward flow of the flushing fluid (typically air) that entrains the cut material. A single opening minimises turbulence and flow disruptions that would otherwise inhibit the axially rearward transport of the cuttings and fines. A single opening also provides space for the differential positioning of the picks at the head. However, according to further specific implementations, the bit may comprise additional or auxiliary fluid flow outlet passageways exiting the head at different regions.

Optionally, the radial and an axial position of the cutting tip of each pick is unique. Accordingly, the front picks are positioned asymmetrically at the head when the bit is viewed along its axial centre. The present bit therefore does not comprise what may be considered symmetrical cutting rows or wings distributed around the axis.

Advantageously, the present bit comprises a plurality of pick holders formed integrally or non-integrally with the head, the picks being detachably mounted at the head via the pick holders. Such a configuration is beneficial for material efficiency as worn picks may be replaced without a need to replace the entire head or bit. Also, picks of different shapes and sizes may be interchanged at the head to optimise the cutting characteristics to suit particular applications and rock types. According to the preferred embodiments, the picks comprise a generally conical configuration having a generally sharp conical cutting tip. Preferably, the picks comprise a pick head mounted on a pick shaft that is received within regions of the head to releasably mount each of the picks via conventional pick mounting arrangements involving internal or external retainers. However, according to further specific implementations, the bit may comprise substantially fixed or non-interchangeable picks being fused, encapsulated and/or bonded to the drill bit, drill head or bit body.

Optionally, where the picks are considered to be arranged into groups according to their angular alignment of each pick at the head relative to the central axis of the bit, the cutting tips of the front picks of each group are positioned at different axial positions. Optionally, the axial position of the cutting tips of the front and gauge picks may be different for all picks at the head such that no two picks comprise a cutting tip positioned at the same axial and radial position.

Preferably, the head comprises a plurality of shoulders extending radially outward and axially rearward from a forward end of the head, each shoulder mounting one of the groups of picks. Preferably, the shoulders comprise tiered sections with each section mounting a respective pick at a particular compound angle and radial and axial position. Accordingly, the orientation of a mount surface of each of the sections according to the preferred embodiment is different to determine the angular alignment of each pick within each group. The tiered sections are advantageous to provide a secure mount for each pick to resist the loading forces during rotation and axially forward advancement into the rock. The tiered sections are also optimised to fit all picks at the head and to distribute them around the single passageway opening.

Optionally, where the picks are considered arranged into groups, the tips of the picks within at least some of the groups are positioned along an axially rearward and radially outward extending path that is curved or bent in the radial direction. Optionally, the path of the respective groups comprises a generally helical profile that extends axially rearward a short distance around the bit axis. The generally helical path configuration enables the relatively close positioning of the picks at the head where each pick is positioned and orientated at a different compound angles and radial and axial positions. The helical distribution also facilitates the radially outward and axially rearward transport of the cut material.

Preferably, a size and a shape of each of the picks is the same. Optionally, the cutting picks within each group may comprise a different size, cone shape or material. In particular, the gauge picks of each group may be generally larger than the radially inner front picks so as to be more resistant to wear.

Optionally, at least the tips of each of the front and gauge picks are located at different radial and/or axial positions at the head. Such a configuration optimises the bit for rock cutting during rotational advancement.

Preferably, the head comprises a mounting flange provided at a rearward end and the body comprises a mounting flange at a forward end to mate with the flange of the head. More preferably, the flange of the head is a male projection and the flange of the body is a recess to receive the projection. Such an arrangement is advantageous to facilitate reattachment of a replacement head onto the body. In particular, the respective male and female mountings at the head and body allow the head to be separated from the body, by for example, cutting the body axially above the male projection such that the male projection is retained within the cavity. The cavity may then be milled conveniently to mate with a replacement head. The material of the body is accordingly preserved. Preferably, the body and the head are fixed together by a weld material. Preferably, the head and body comprise substantially planar attachment faces between which the weld material may be applied. Additionally, the head and body may comprise radially inward tapered regions that when the head and body are mated together define an annular channel or groove within which the weld material may be applied to provide secure attachment of the head and body.

According to a second aspect of the present invention there is provided a kit of parts for a rotary claw drill bit as claimed herein wherein the body, the head and the picks are separate pieces attachable together.

According to a third aspect of the present invention there is provided a rotary claw drill bit comprising: a body having a rearward region for attachment of the bit to a drill string, a bore extending axially through the body; a head provided at a forward end of the body and having an axially extending bore to align with the bore of the body; a plurality of picks mounted at the head, each pick having a cutting tip; wherein the head and body are non-integrally formed; and wherein the tips of each of the picks are located at different radial and/or axial positions out the head so as to be distributed asymmetrically at the head.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
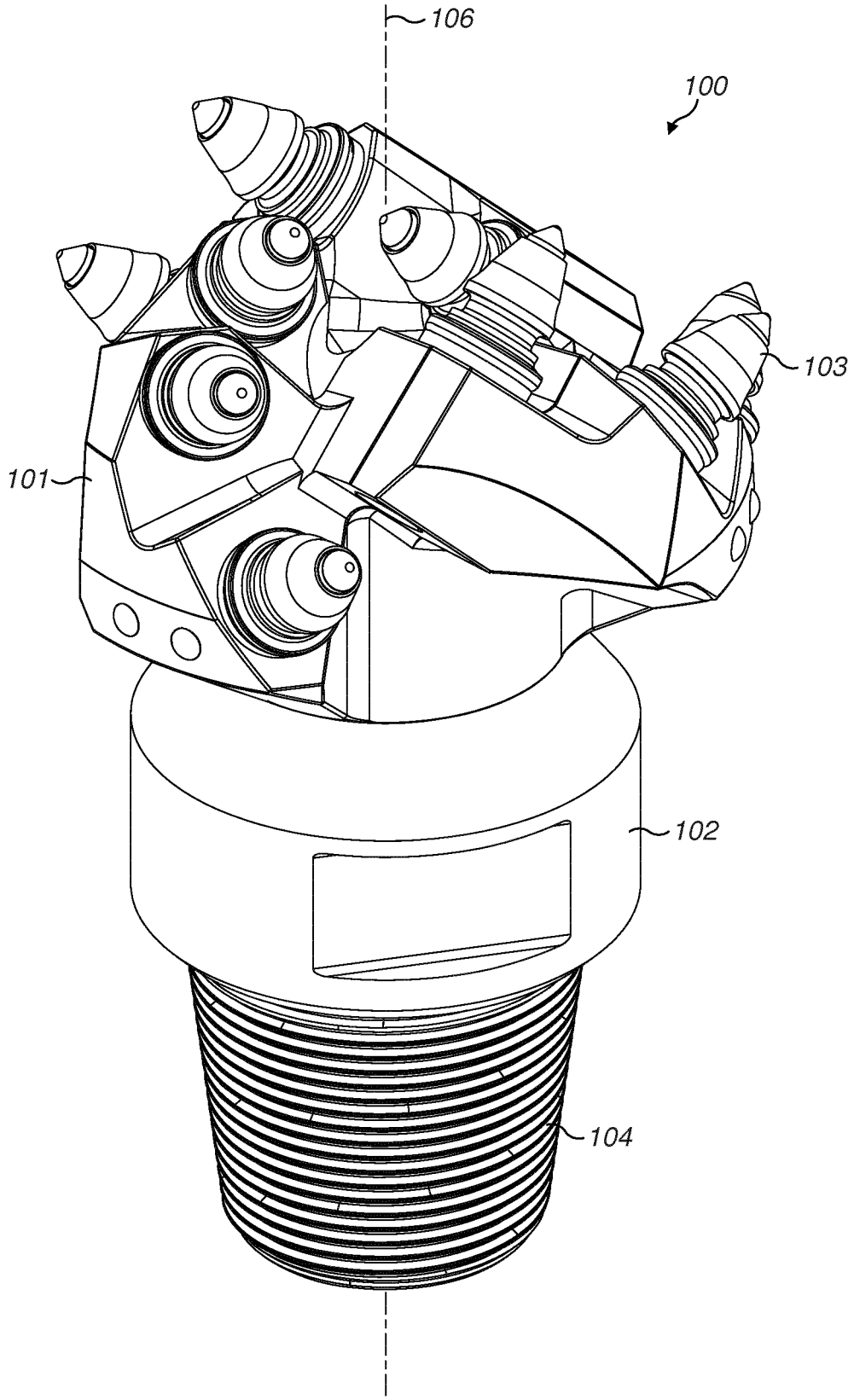
FIG. 1 is a perspective view of a rotary claw drill bit comprising a body and a head mounting a plurality of picks arranged into cutting groups according to a specific implementation of the present invention.
Figure 2:
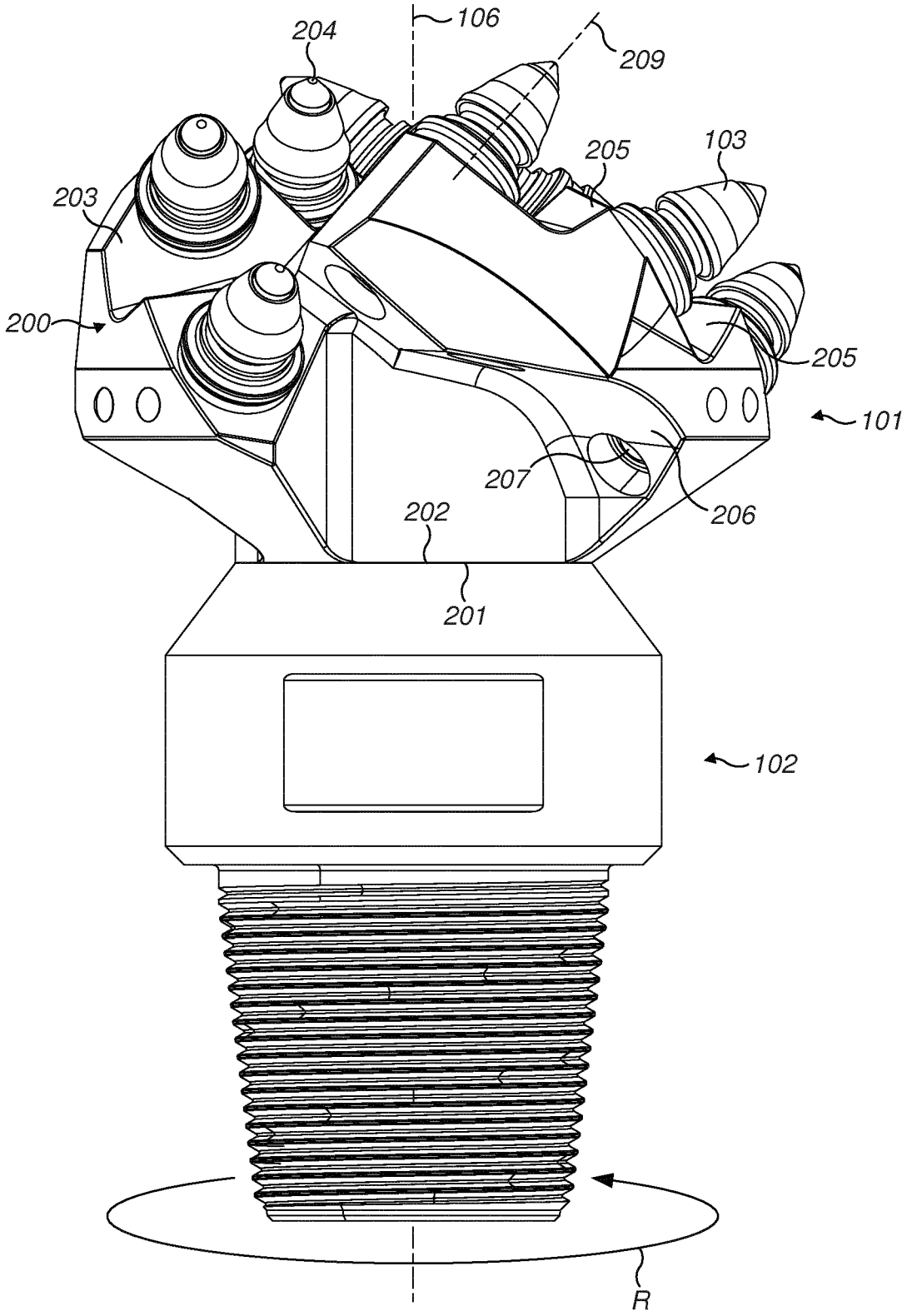
FIG. 2 is a side view of the bit of FIG. 1.
Figure 3:
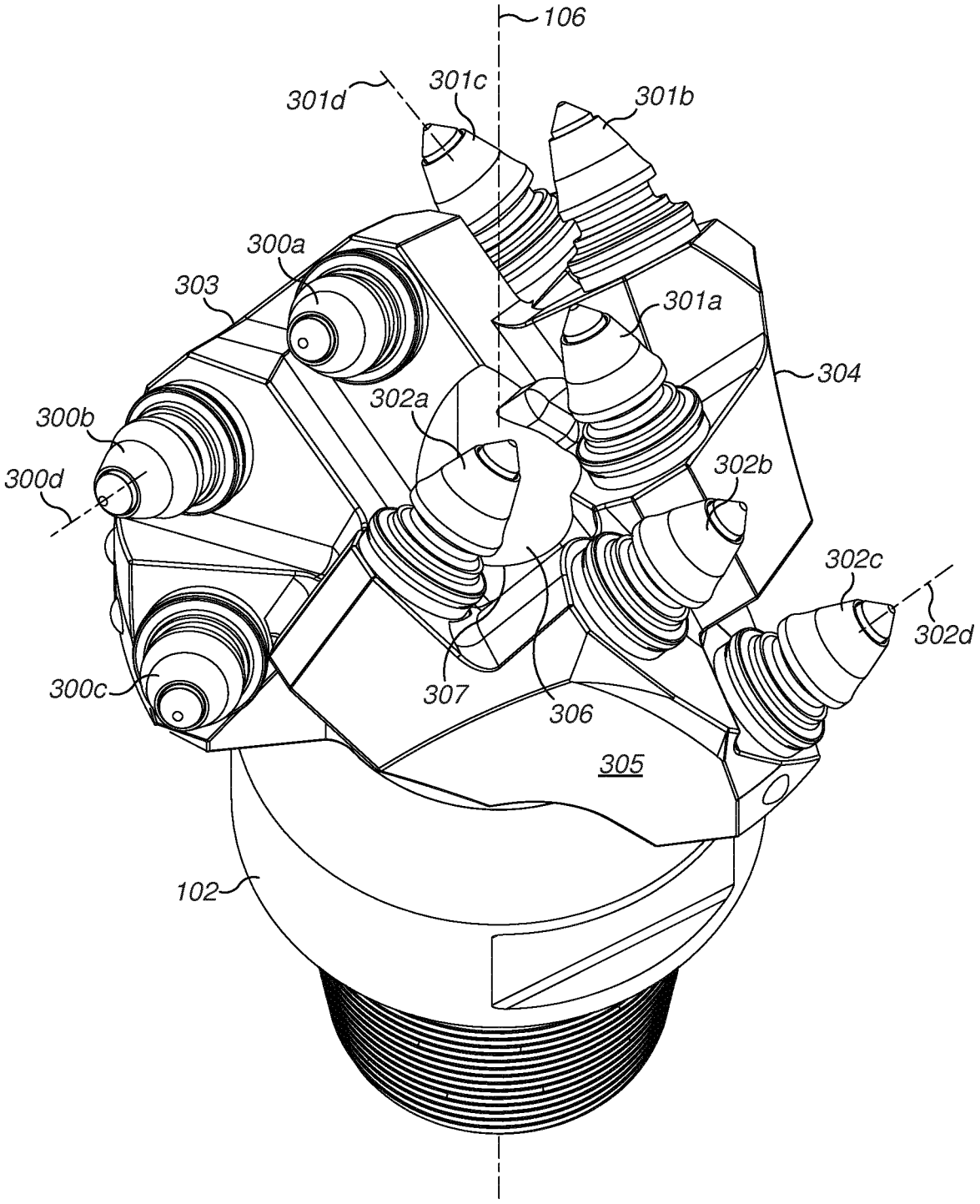
FIG. 3 is an upper perspective view of the bit head of FIG. 2.

Referring to FIGS. 1 to 3, bit 100 comprises a head indicated generally by reference 101 rigidly attached to a body indicated generally by reference 102. Head 101 comprises a plurality of cutting picks 103 having cutting tips 204 that project generally axially forward at head 101 so as to represent the cutting end of bit 100. Body 102 comprises an axially rearward portion comprising threads 104 to mount bit 100 to a drill string (not shown). Head 101 comprises three radially and axially extending shoulders indicated generally by reference 200 with three picks 103 mounted at each respective shoulder 200. Each shoulder 200 comprises a mount surface indicated generally by reference 203 into which is mounted each of the cutting picks 103. Mount surface 203 along each shoulder 200 is divided into three tiered regions that form stepped sections with the mount surface 203 of each section separated by a step surface 205 that is aligned transverse and in particular perpendicular to the mount surface 203 of each section. The mount surface 203 at each shoulder section is aligned at different compound angles so as to be tilted relative to a longitudinal axis 106 of bit 100 and to lean or slope rearwardly relative to the rotational direction R of the bit 100.

According to the specific implementation, picks 103 comprise a generally conical shape configuration having a respective central axis 209 that is orientated perpendicular to the mount surface 203 at each stepped section. Additionally, each of the pick axes 209 is aligned at a compound angle being transverse to bit central axis 106 and to lean into the bit rotational direction R such that the tip 204 of each bit represents the leading part. At least some of the picks are orientated to tilt towards the axis 106 (such that tip 205 is radially closer to axis 106 than a base of the pick) whilst some picks are tilted such that their tips 204 are inclined to be pointing away from the axis 106. Each shoulder 200 comprises a corresponding rearward surface 206 positioned behind mount surface 203.

Figure 8:
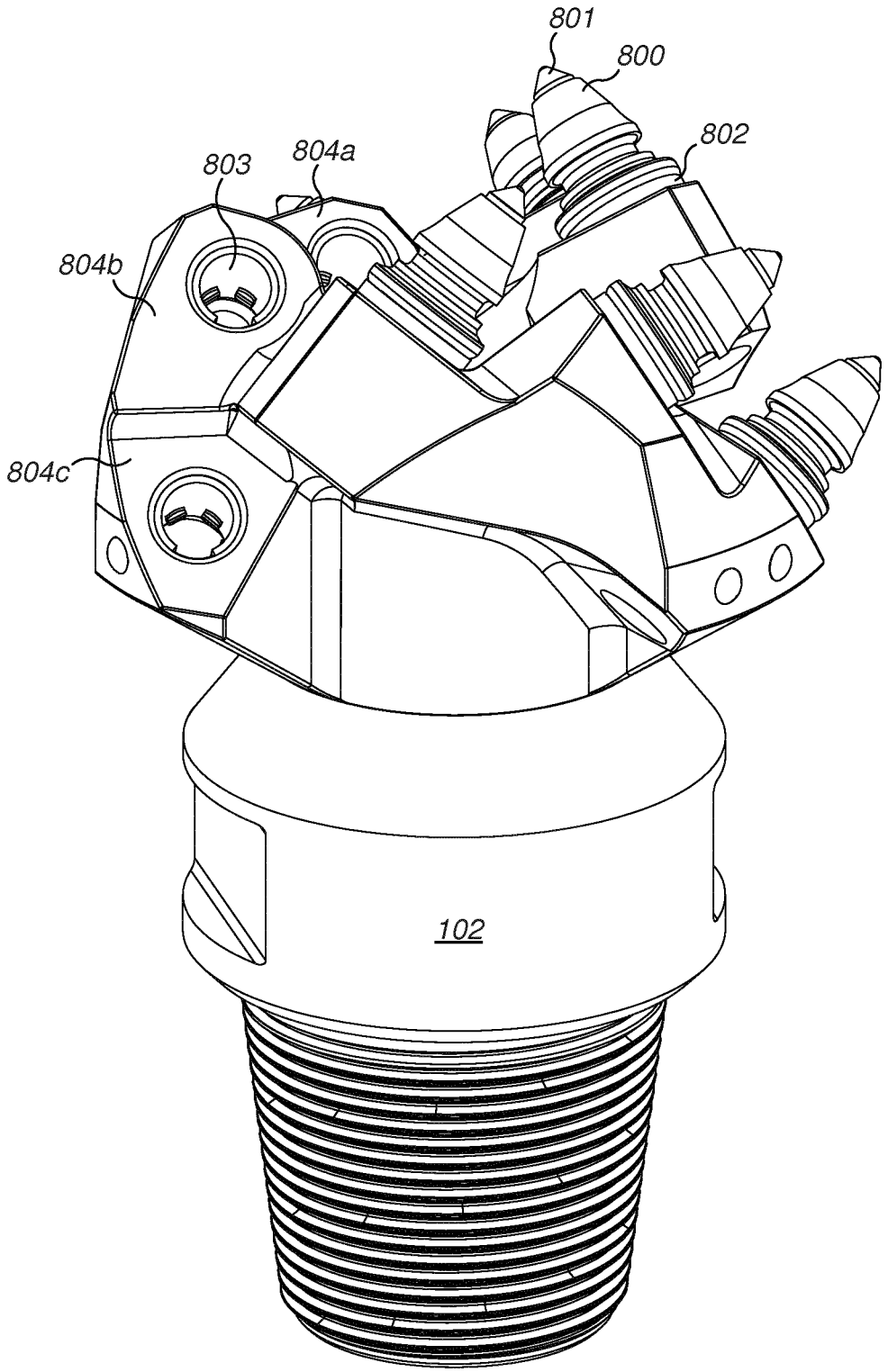
FIG. 8 is a further perspective view of the bit head of FIG. 3 with selected cutting picks removed from the head.

Referring to FIGS. 2 and 8 each pick 103 comprises a frusto-conical pick body 800 that mounts a cutting tip piece 801. Body 800 is provided at one end of an elongate pick shaft (not shown) that extends through shoulder 200 and in particular a pick bore 803 extending from shoulder mount surface 203 to shoulder rearward surface 206. Optionally, a pick washer 802 positionally supports pick body 800 at mount surface 203 with each pick shaft extending through each bore 803 and is secured in position via a retainer indicated generally be reference 207. As shown in FIG. 8, each of the three shoulders 200 comprises a series of tiered sections including a first shoulder section 804*a* a second shoulder section 804*b* and a third shoulder section 804*c*. Each section 804*a*, 804*b*, 804*c* is positioned to extend radially outward from axis 106 and to extend generally axially rearward in the general direction of bit head 101 towards bit body 102.

Figure 4:
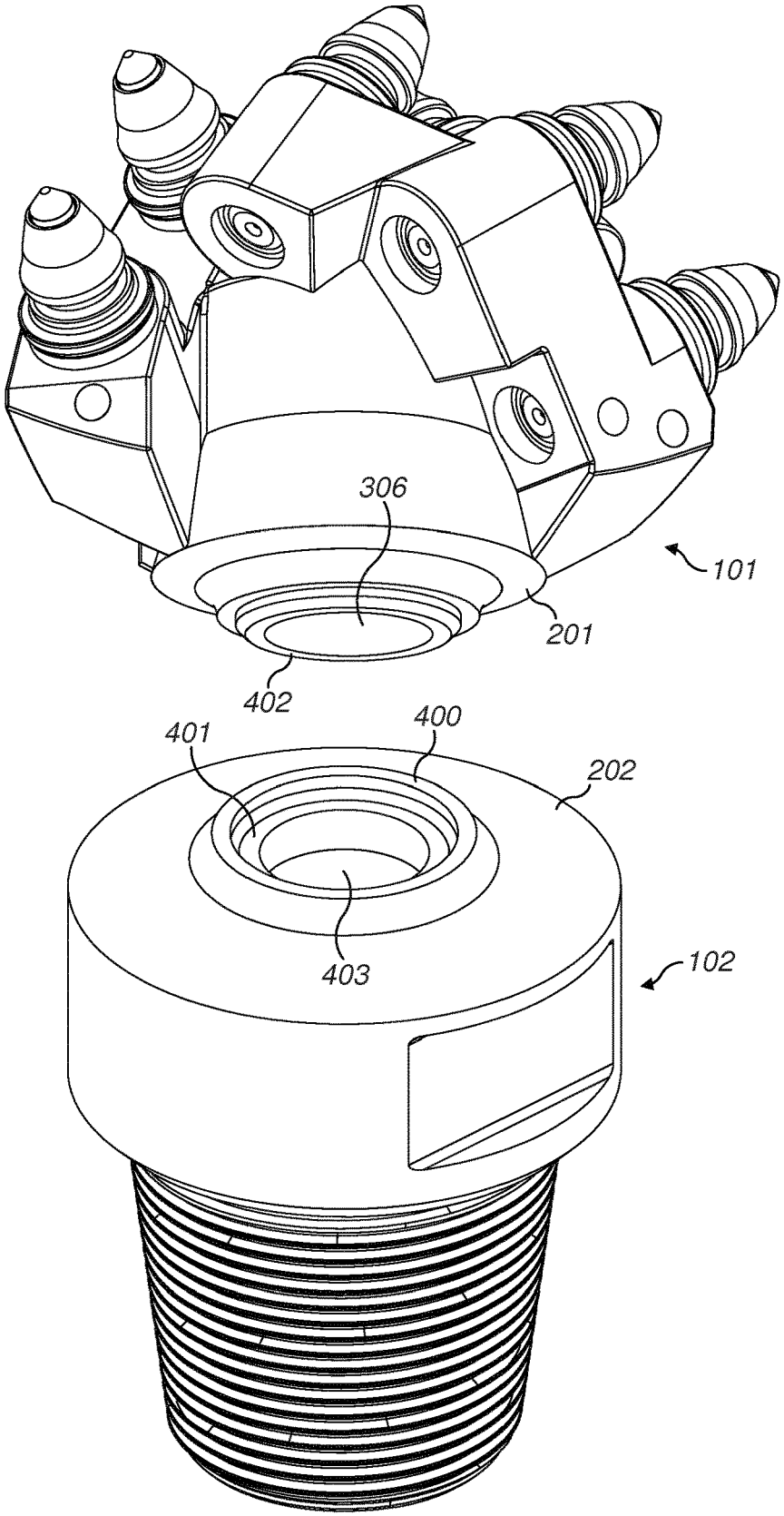
FIG. 4 is a partial exploded perspective view of the bit of FIG. 2.
Figure 7:
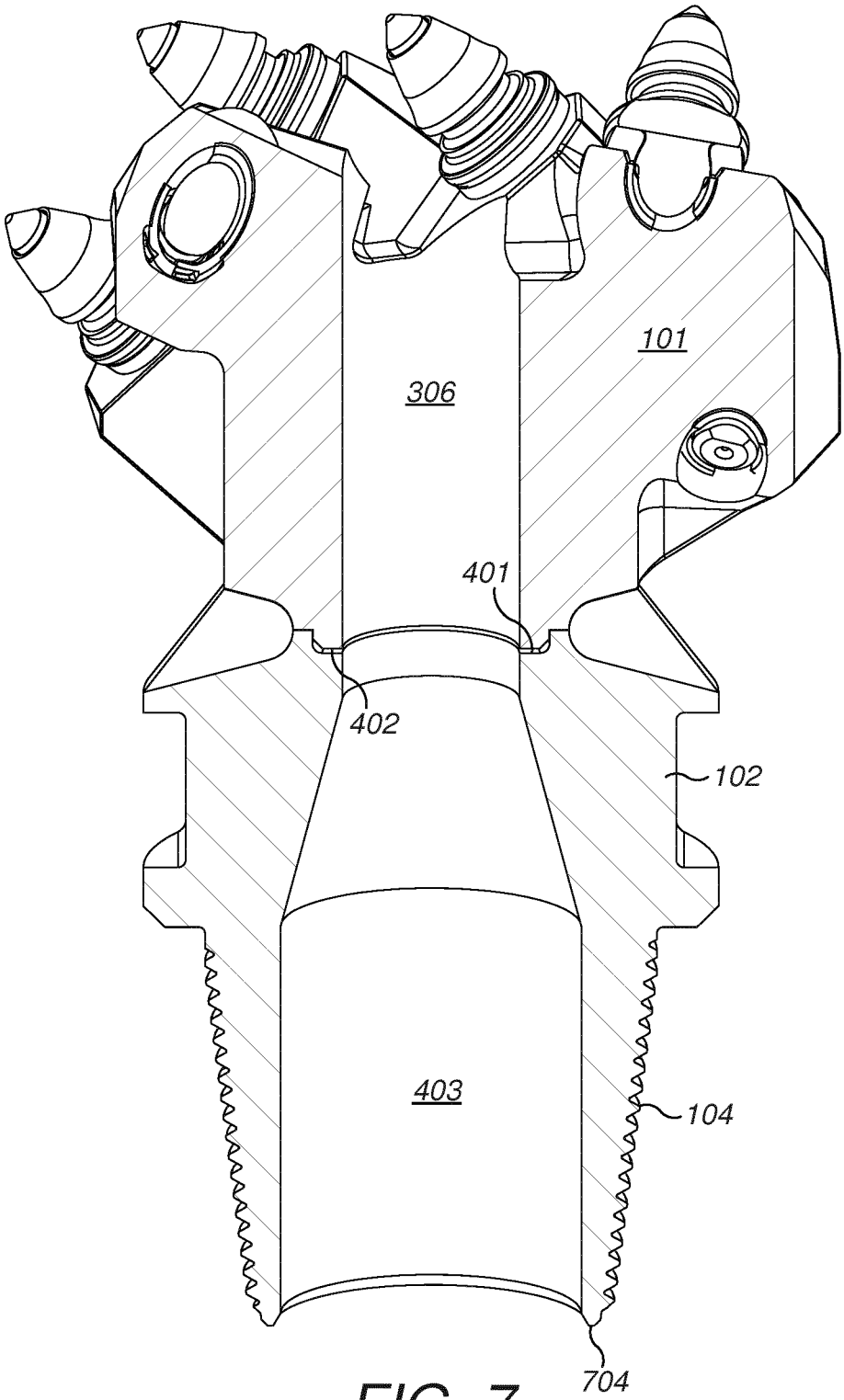
FIG. 7 is a longitudinal cross sectional perspective view of the bit of FIG. 2.

Referring to FIGS. 2 and 4, head 101 comprises an axially rearward annular attachment face 201 configured to mate in touching contact with an axially forward annular attachment face 202 of bit body 102. An annular attachment neck or flange 402 projects axially rearward from head attachment face 201. A corresponding annular collar 400 projects axially forward from body attachment face 202 and is configured to receive neck 402 within a cavity region 401 defined by collar 400. Via the appropriate mating of neck 402 within collar 400, bit head 101 may be appropriately aligned and mounted onto body 102. A weld material is applied between and at the junction of the attachment faces 201, 202 so as to secure head 101 to body 102. A bore 306 extends centrally through head 101 and is aligned radially with a corresponding bore 403 extending within body 102 such that the two bores 306, 403 define a single bore that extends axially from a rearwardmost annular edge 704 at body 102 to a single bore opening 307 at head 101 referring to FIGS. 3 and 7.

Figure 5:
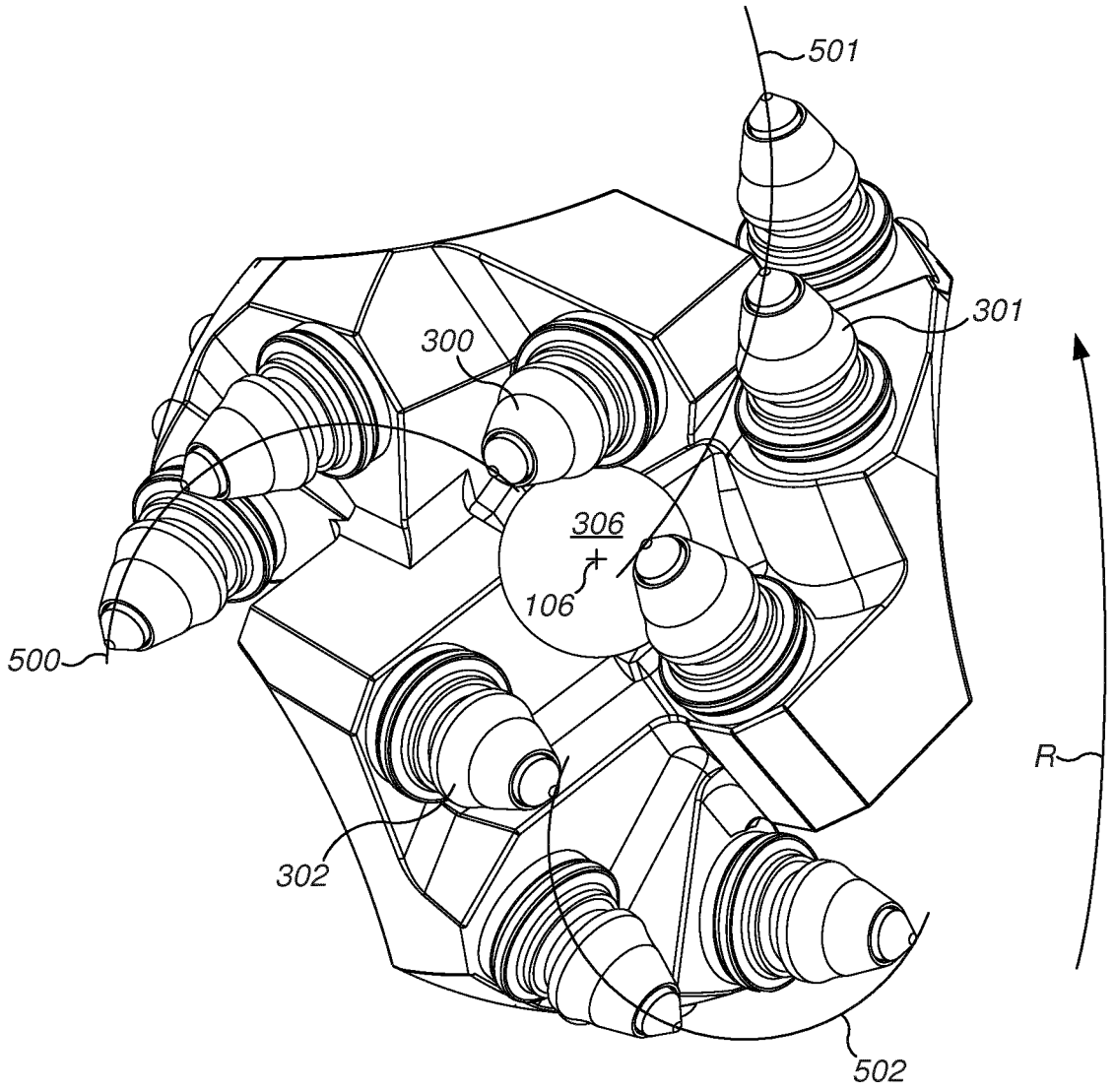
FIG. 5 is a plan view of the bit of FIG. 2.

As illustrated in FIGS. 3 and 5, the three shoulders 200 project radially outward around bore opening 307 to form three radially extending wings mounting each of the picks 103 at their respective tiered sections. In particular, a first shoulder 303 provides a mount for a first group of picks 300*a*, 300*b*, 300*c*; a second shoulder 304 provides a mount for a second group of picks 301*a*, 301*b*, 301*c*; and a third shoulder 305 provides a mount for a third group of picks 302*a*, 302*b*, 302*c*. As illustrated with reference to FIG. 8, each of the three shoulders 303, 304, 305 comprises a corresponding mount surface 203 that is divided into stepped sections 804*a*, 804*b*, 804*c* such that each pick of each of the groups is positioned at a respective step S04*a*, 804*b*, 804*c* at each of the respective shoulders 303, 304, 305. The mount surface 203 of each shoulder 303, 304, 305 is positioned to sit on a generally helical path that extends radially outward and axially rearward around axis 106 from the region of bore opening 307 that is centred on axis 106. As illustrated in FIG. 3, within each group of picks, each pick comprises an angular alignment that is generally similar and that is different to the angular alignment of the picks of the remaining groups. As the picks within all groups are positioned on a path having a generally helical profile that extends around axis 106, the alignment of each pick 300*a*, 300*b*, 300*c* within each group is not identical but is generally similar so as to define a collective set of picks that are configured to cut the rock in a coordinated manner and to create concentric grooves in the rock that act to stabilise axially forward drilling and bit steering. In particular, the axis 300*d* of the first group of picks 300*a*, 300*b*, 300*c* is transverse to the axis 301*d* of the second group of picks 301*a*, 301*b*, 301*c* that is in turn aligned transverse to the axis 302*d* of the third group of picks 302*a*, 302*b*, 302*c*.

Figure 6:
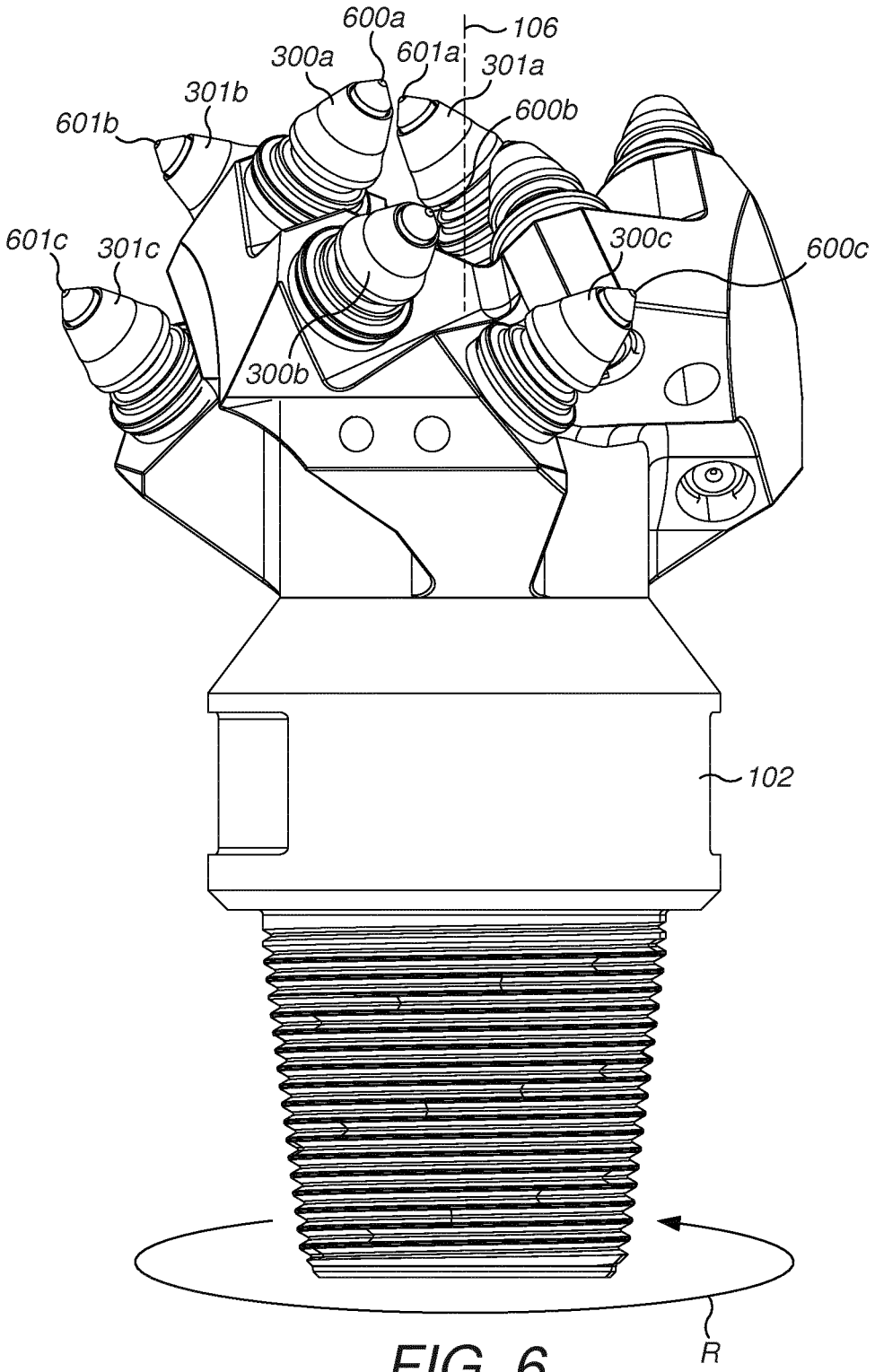
FIG. 6 is a magnified side view of the bit head of FIG. 3.

Referring to FIGS. 5 and 6, an apex cutting tip 600*a*, 600*b*, 600*c* (illustrated with reference to the first group of picks 300*a*, 300*b*, 300*c*) are aligned on helical path 500 that projects radially outward and axially rearward relative to axis 106. The cutting tips of the picks of the second and third groups 301, 302 are similarly aligned on respective helical paths 501, 502 that extend radially outward and axially rearward at head 101. The axial and radial position and alignment of each respective mount section 804*a*, 804*b*, 804*c* at each shoulder 303, 304, 305 is different so as to provide a different axial and radial position and alignment of each of the respective picks 103 of each of the groups of picks such that a radial and axial position of each cutting tip (for example 600*a* to 600*c* and 601*a* to 601*c*) is different for all picks 103 at head 101.

Referring to FIGS. 3 and 5, one pick 300*a*, 301*a*, 302*a* is positioned radially innermost; a corresponding second pick of each group 300*c*, 301*c*, 302*c* is positioned radially outmost relative to axis 106 and a third pick of each respective group 300*b*, 301*b* and 302*b* is positioned radially intermediate the respective first and second picks to create three cutting wings that are bent in the radially outward direction from axis 106. Accordingly, the first and third picks 300*a*, 301*a*, 302*a*, 300*b*, 301*b* and 302*b* may be termed front picks and the second picks 300*c*, 301*c*, 302*c* may be termed gauge picks. Each of the radially innermost front picks 300*a*, 301*a*, 302*a* are positioned radially inside and axially forward of all the intermediate front picks 300*b*, 301*b*, 302*b*. Additionally, the intermediate front picks 300*b*, 301*b*, 302*b* are positioned radially inside and axially forward of all of the gauge picks 300*c*, 301*c*, 302*c*. The cutting tips 204 of the gauge picks 300*c*, 301*c*, 302*c* represent a radially outermost part of bit 100 and determine the diameter of the borehole during drilling.

According to the specific implementation, a radial separation distance of the tip 204 of each of the radially innermost set of front picks 300*a*, 301*a*, 302*a* is different and a corresponding radial separation distance from axis 106 of the intermediate front picks 300*b*, 301*b*, 302*b* is also different within these two sets of front picks. Also, as can be seen from FIG. 6, the axial position of each tip 204 of the front picks 300*a*, 300*b*, 301*a*, 301*b*, 302*a*, 302*b* relative to, for example, the axially rearward attachment surface 201 is different. This individual radial and axial positioning of each tip 204 of the inner front picks is advantageous to contact different radial and axial positions of the rock face to optimise rock fracture during rotation of bit 100. Such a configuration also facilitates uniform wear across the different picks to maximise the period between which the picks are required to be interchanged when worn.

According to the specific implementation, the radial separation distance of the tip 204 of each of the gauge picks 300*c*, 301*c*, 302*c* and the axial position relative to the rearward attachment surface 201 is approximately equal. Such a configuration is advantageous to stabilise forward drilling and facilitate steering/guidance of the bit in use. However, according to further specific implementations, the radial and axial position of the respective tips 204 of the gauge picks 300*c*, 301*c*, 302*c* may be different within this set of picks so as to enhance the rock breaking characteristics of the bit and hence the drilling rate.

Figure 9:
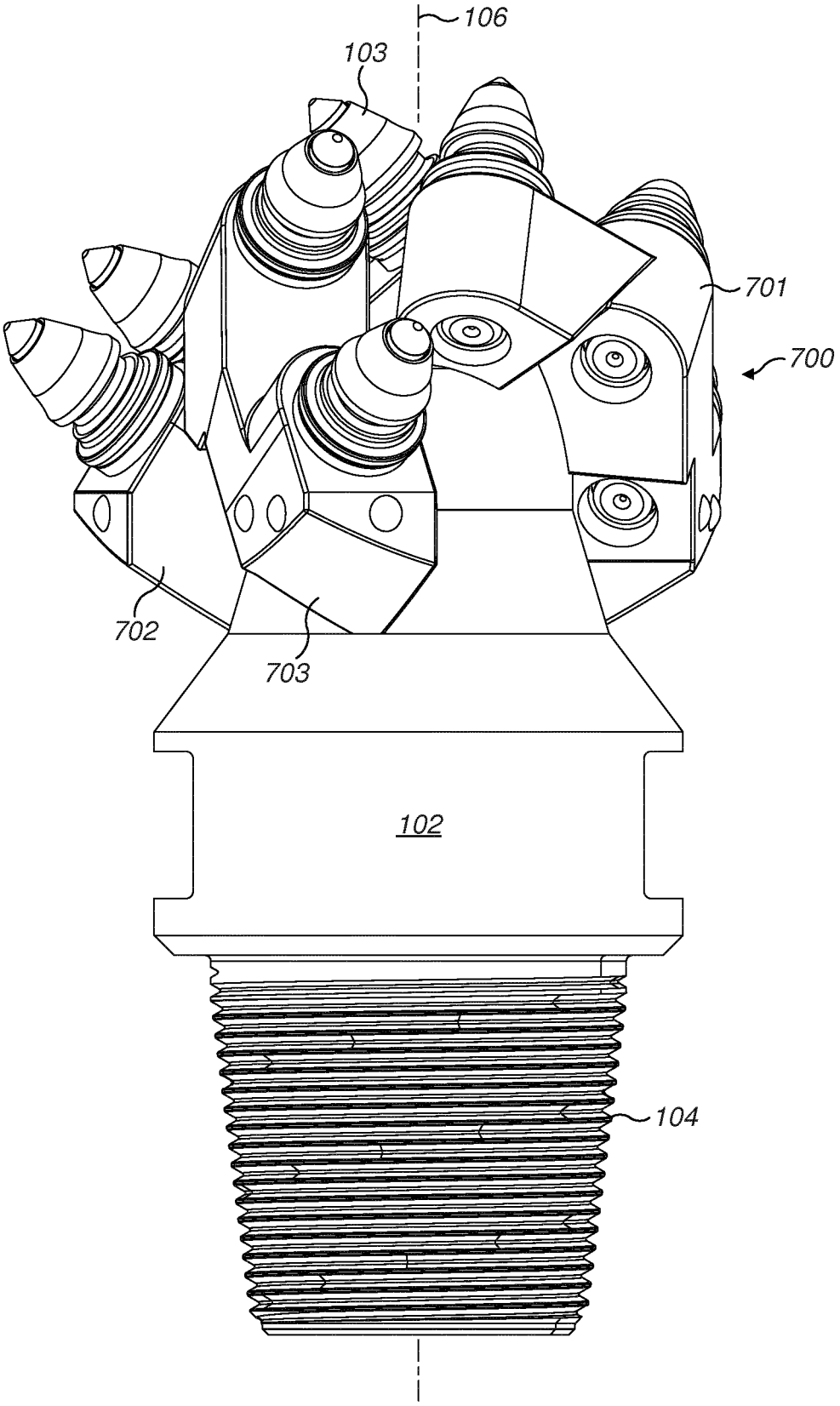
FIG. 9 is a perspective view of a rotary claw drill bit according to a further specific implementation of the present invention.
Figure 10:
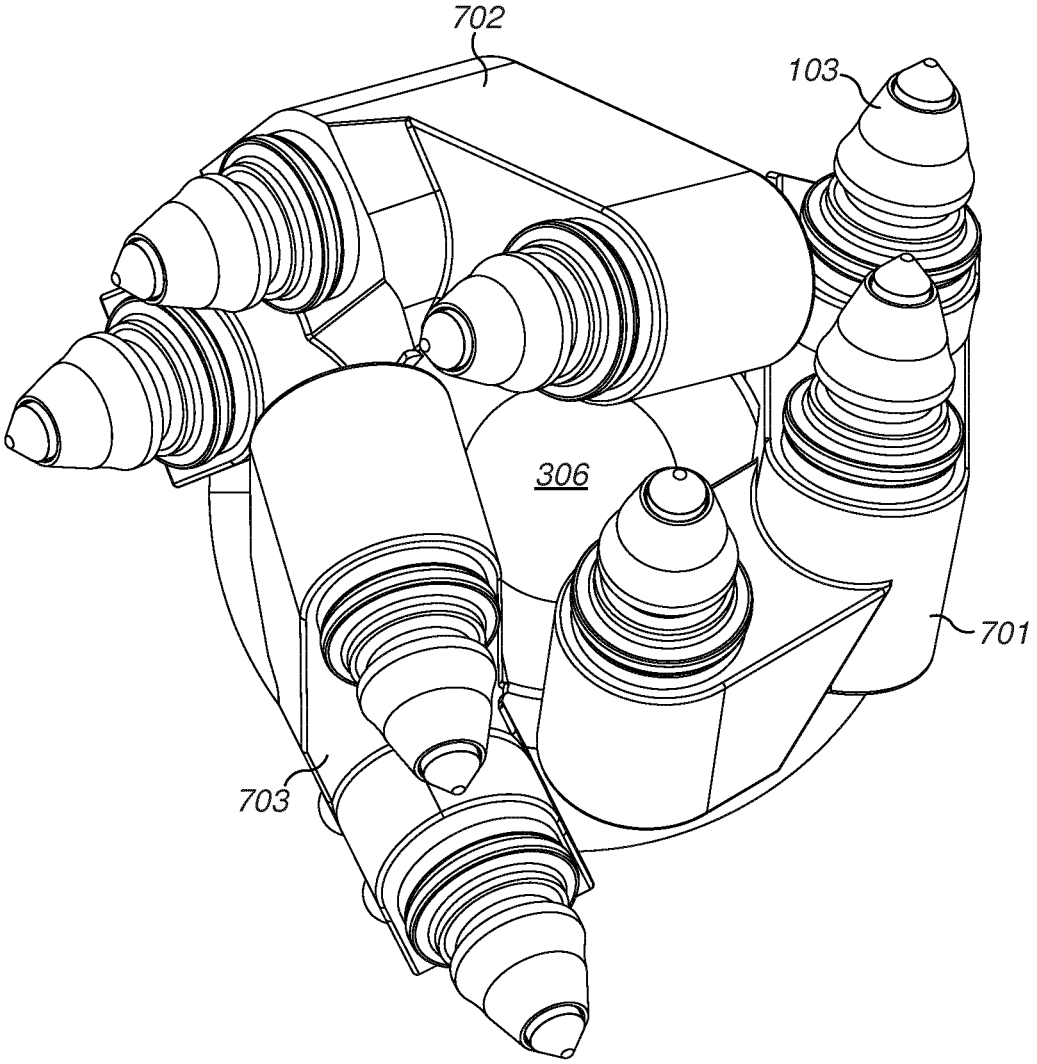
FIG. 10 is a plan view of the cutting head of the bit of FIG. 9.

FIGS. 9 and 10 illustrate a further embodiment of the present invention in which pick head 700 comprises three corresponding shoulders 701, 702, 703. Three picks 103 are provided at the first and second shoulders 701, 702 whilst two picks 103 are provided at third shoulder 703. As with the embodiment of FIGS. 1 to 8 each of the shoulders 701, 702, 703 extend generally along a radially outward and axially rearward extending path relative to axis 106 and comprise the corresponding tiered sections and mount surfaces 804*a*, 804*b*, 804*c*.

The invention claimed is:

1. A rotary claw drill bit comprising:

a central axis;

a body having a rearward region for attachment of the bit to a drill string;

a bore extending axially through the body;

a head provided at a forward end of the body and having an axially extending bore arranged to align with the bore of the body, wherein the bore of the head exits the head as a single opening positioned at the axis of the bit, the head including an axially rearward annular attachment face mating with an axially forward annular attachment face of the body such that the head and body are non-integrally formed along the respective attachment faces; and a plurality of picks mounted at the head, each pick having a cutting tip, the picks including radially inner front picks and radially outermost gauge picks, wherein a radial separation distance of the cutting tips of each of the front picks from the axis is different and an axial position of the tips of each of the plurality of front picks is different from an axial position of the tips of other picks of the plurality of front picks at the head, and wherein the picks are arranged into groups, and the head includes a plurality of shoulders extending radially outward and axially rearward from a forward end of the head, each shoulder mounting one of the groups of the picks such that each of the groups are mounted on a separate shoulder.

2. The bit as claimed in claim 1, wherein the front picks are positioned at the head asymmetrically.

3. The bit as claimed in claim 1, wherein the head includes a plurality of pick holders formed integrally or non-integrally with the head and the picks are detachably mounted at the head via the pick holders.

4. The bit as claimed in claim 1, wherein the picks are arranged into groups according to an angular alignment of each pick at the head relative to the central axis of the bit, wherein within a same group picks, the picks includes include an alignment that is the same or similar to one another relative to the alignment of the picks of another group.

5. The bit as claimed in claim 4, wherein the tips of the picks within at least some of the groups are positioned along an axially rearward and radially outward extending path that is curved or bent in the radial direction.

6. The bit as claimed in claim 5, wherein the path of respective groups includes a helical profile being curved or bent radially outward and extending axially rearward.

7. The bit as claimed in claim 1, wherein a size and a shape of each of the picks is the same.

8. The bit as claimed in claim 1, wherein at least the tips of each of the front and gauge picks are located at different radial and/or axial positions at the head.

9. The bit as claimed in claim 1, wherein the head includes a mounting flange provided at a rearward end and the body includes a mounting flange at a forward end arranged to mate with the flange of the head.

10. The bit as claimed in claim 9, wherein the flange of the head is a male projection and the flange of the body is a recess to receive the projection.

11. The bit as claimed in claim 1, wherein the body and the head are fixed together by a weld material.

12. A kit of parts for a rotary claw drill bit, the kit comprising:

at least one body having a rearward region for attachment of the drill bit to a drill string, a bore extending axially through the at least one body;

at least one head connectable to a forward end of the at least one body and having an axially extending bore arranged to align with the bore of the at least one body, wherein the bore of the head extends axially from the head as a single opening positioned at the axis of the bit, the head including an axially rearward annular attachment face mating with an axially forward annular attachment face of the body such that the head and body are non-integrally formed along the respective attachment faces; and a plurality of picks attachably mountable at the at least one head, each pick having a cutting tip, the picks including radially inner front picks and radially outermost gauge picks, a radial separation distance of the cutting tips of each of the front picks from an axis of the drill bit being different, wherein the body, the head and the picks are separate pieces attachable together, and an axial position of the tips of each of the plurality of front picks is different from an axial position of the tips of other picks of the plurality of front picks at the head, and wherein the picks are arranged into groups, and the head includes a plurality of shoulders extending radially outward and axially rearward from a forward end of the head, each shoulder mounting one of the groups of the picks such that each of the groups are mounted on a separate shoulder.

* * * * *